United States Patent [19]

Timson

[11] Patent Number: 5,027,968

[45] Date of Patent: Jul. 2, 1991

[54] CONTAINER CONSTRUCTION

[76] Inventor: William J. Timson, 102 Tahanto Rd., Pocassett, Mass. 02559

[21] Appl. No.: 606,564

[22] Filed: Oct. 31, 1990

[51] Int. Cl.[5] ..... B65D 17/00

[52] U.S. Cl. ..... 220/269; 220/94 R

[58] Field of Search ..... 220/94 R, 269, 270, 220/296, 305; 215/100 A, 305; 229/160.2

[56] References Cited

U.S. PATENT DOCUMENTS 3,318,495 5/1967 Roberts ..... 220/270 X 4,167,234 9/1979 Gordon et al. ..... 220/270 X 4,289,250 9/1981 Jordan ..... 220/270 X 4,762,246 8/1988 Ashley et al. ..... 220/270

*Primary Examiner*—Steven M. Pollard

*Attorney, Agent, or Firm*—Paul J. Cook

[57] ABSTRACT

A container is provided with a top to which is secured at least one strip. The strip or strips are provided with a prestress bias so that when the top is severed from the container, the strip or strips are lifted away from the top so that the strip can be grasped easily to provide a means for lifting the top away from the container.

13 Claims, 2 Drawing Sheets

CONTAINER CONSTRUCTION

BACKGROUND OF THE INVENTION

This invention relates to a container construction comprising a container having a sealed cover which can be manually removed from said container when the cover is severed from the container. More particularly, this invention comprises a container construction having a cover which includes strip means which promotes ease of manual removal of the cover from the container when the cover is severed from the container.

Prior to the present invention, containers such as metallic or plastic containers have been provided with a cover which can be opened by hand. These containers included the construction having a "pop-top" opener handle which is formed integrally with the cover and can be lifted by hand to form an opening in the cover which is defined by a previously molded indentation in the cover. These containers have been designed either to form a centrally located opening in the core such as is common in beverage container or can be found to extend about the cover periphery to remove the cover, as is common in processed foods such as cheese products. The opener handles which form a central opening are not useful when the container contains a solid product such as a food product since the product cannot be easily removed from the container. The handle openings which permit removal of the entire cover are expensive and are not desirable for use with containers that contain inexpensive products such as pet foods.

It has also been proposed in U.S. Pat. No. 2,637,465 to provide a handle which can be bent away from a can top so that the can top can be subsequently lifted away from the can after the top has been cut. This handle means is undesirable since force is required to bend it away from the can which force would force the contents onto the top after it is cut. In addition, it is expensive to produce.

It would be desirable to provide a container construction which includes a cover which can be easily manually removed from the container when the cover is severed without interfering with the container's contents such as by contacting the user with the container contents or by causing the cover to sink into the container as is in the case of liquid products such as soups.

SUMMARY OF THE INVENTION

The present invention provides a container construction with a top having a handle in the form of a strip or a plurality of strips. The strips are prestressed and secured to the container in a manner such that when the container top is cut about its periphery when opening the container, the strip or strips, under the prestressing forces, lift away from the container top to a position where they can easily be grasped. The requirement of manual force to lift the strips away from the container is eliminated so the container contents are not disturbed when the top is removed from the container. The strips are adhered to a portion of the exposed top surface while an end of each strip is free from the surface or can be rendered free from the surface when the top is cut so that it can be manually grasped after the top is cut away from the container body.

DESCRIPTION OF SPECIFIC EMBODIMENTS

Figure 1:
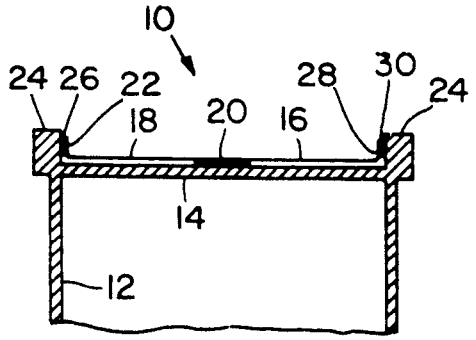
FIG. 1 is a cut-away view of a container top with strips adhered to the top periphery.

By the term "strip" as used herein is meant an element having a flat surface such as a portion of a sheet material or a curved surface such as filament which has a length such that it can be grasped manually. The strip is formed of a material which can be prestressed so that when it is released from the forces which cause it to remain stationary, it moves, under the prestressing forces, away from the container top. For example, the strip can be formed of a polymeric composition such as a thermoplastic composition which can be prestressed by heat or light energy or from a metallic composition.

The container top of this invention includes one or more strips, usually a plurality of strips which are secured, at one end thereof to a central portion of the top and at a second end thereof adjacent the periphery of the top. The second end of each strip is secured near the top periphery so that it can be cut with the cutting tool used to open the container. Since the first end of the strip is secured to a central portion of the top, when the second end is cut, it lifts away from the top due to the prestressed bias previously imposed into the strip. In the case of a thermoplastic strip, the prestressed bias can be imposed after the strip is secured to the can top by exposing the top surface of the strip to irradiation energy such as heat which induces the bias into the top portion of the strip. It is to be understood that any means for inducing the prestressed bias into the strip can be utilized in the present invention including prebending.

In the manufacture of can tops, the tops are stamped out of thin flat sheet stock, that may be coated inside (one side) or both sides with a polymer composition. The sheet stock which is usually a steel composition can also be tin coated. To conveniently attach the strips onto the can tops during manufacture the strips can be placed on the sheet stock as elongated strips which extend the length of the sheet stack prior to the stamping operation.

When the strips are secured to the can top by an adhesive, the adhesive can be placed on the strips prior to placing them on the sheet stock or the sheet stock can be stamped with adhesive spots prior to placing the strip on a cross patch having adhesive. The sheet stock alternatively can be placed over the center of the strip on each can top to be stamped to provide adherence of the strip to the can top to be produced. In any event, the means for adhering the strip is positioned on the top surface so that a strip can be easily grasped when it is desired to remove the can top from the can body. The strip can be glued onto the can top with a water soluble and/or temperature degradable adhesive that will loose its original adherence to the top during the steam sterilizing process of the food, thereby releasing the prestressed feature of the strip when the top is cut open with a can opener. The cross patch which has the permanent adhesive maintains the strip on the can top. The thickness of the strip should be thin enough so that it will not interfere with the can closing crimping operation during canning of the food product.

Various can tab designs which are secured to a can top can be utilized in the present invention. For example, a portion of the strip can be secured to the can top or to itself with a temporary adhesive which loses its adhesive strength upon application of heat or upon exposure to typical can sterilization conditions. A second portion of the strip is secured to the can top with a permanent adhesive capable of retaining its adhesive strength when exposed to heat or sterilization conditions. The portion of the strip secured by the temporary adhesive can be prestressed so that when the temporary adhesive looses its adhesive strength, it moves away from the can top under the prestress forces so that it can be easily grasped when it is desired to remove the top from the can body.

Bi-compositional or multicompositional strips can be utilized on the strip and are composed of a less shrinking bottom layer and a more-shrinking upper layer. Differential shrinking can be achieved by many means including chemical cross-linking, thermal shrinking, plasticiser loss, aging or the like.

To obtain a length-stable bottom layer, the bottom layer can be made of a suitable metal, such as stainless steel, aluminum, iron, copper alloys or a suitable dimensionally stable plastic, such as polysulfone, polycarbonate, polyimide, polyethermide or polyester. The upper layer can be formed of a shrinkable polymer that shrinks to a desired amount to give the desired pre-stressed curl to the strip such as heat treatment, including a poly olefin such as polyethylene or polypropylene, polyethylene vinyl acetate and other copolymers, polystyrene butadiene, polyvinylidene chloride. The bottom and top layers can be co-extruded and can be laminated. Alternatively, fibers, of lower and higher thermal shrinking can be sandwiched to a polymer strip to provide the desired strip bending.

Stressing of can tabs also can be achieved by differential contraction of a bi-compositional strip which has more shrinkage on the upper layer than on the bottom layer when the strip is heated during steam sterilization or other heat application. Multilayered strip compositions utilizing this feature also can be used. Alternatively, a strip of a single composition can be shrunk on the upper surface by a rapid heat pulse such as shrinkage on one surface of the strip to provide desired prestressing for strip bending.

To facilitate industrial attachment of the can top strips, the application of the strip can be achieved during the manufacture of the can top from sheet metal. The circular can top is normally first stamped out of a sheet of metal to obtain a circle of sheet metal which is then further stamped or shaped into a can top by crimping the can top edge about the open can body periphery. The tab can be applied to the sheet metal appropriately before stamping of the circles, in a manner where the can top contain strips with adhesive at the center and at the ends of the strip. Thus, the can top will have the tab strip on it prior to use in canning. In the canning operation the can top strip is crimped into the can crimp and automatically becomes available for use without the need of attachment after canning shown in FIG. 7.

The strip can be placed on the can in any desired direction, that is radially pointing outward, inward or tangentially. When the strips are sufficiently flexible and hold their set prestressed shape well, they can be handled, stacked, stored and passed through a can opening process without difficulty.

Figure 4:
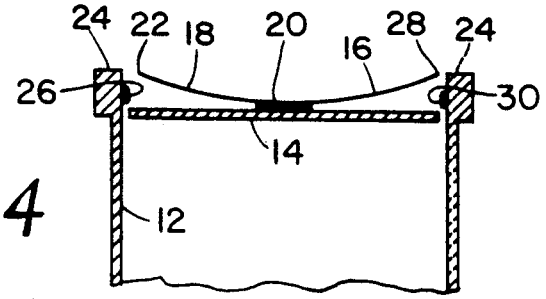
FIG. 4 is a side view of a container top after it has been cut.
Figure 5:
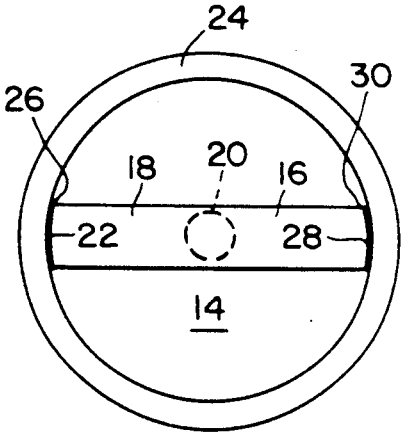
FIG. 5 is a top view of a container top.

Referring to FIGS. 1, 4 and 5, the container 10 of this invention includes a container body 12, a sealed top 14 and strips 16 and 18. Strips 16 and 18 are secured to a central portion of top 14 such as with an adhesive or solder 20. A second end 22 of strip 18 is secured to the lip 24 by means of an adhesive or solder 26. A second end 28 of strip 16 is secured to lip 24 by means of an adhesive or solder 30. The strips 16 and 18 are prestressed so that when they are cut at their second ends 22 and 28 when the can top 14 is cut about its periphery, (See FIG. 4), the strips 16 and 18 are biased away from the top 14 and can be easily grasped since they are free from contact with the top 14. Thus, the top 14 can be easily lifted manually away from the container body 12 by gripping the free end of a strip.

Figure 2:
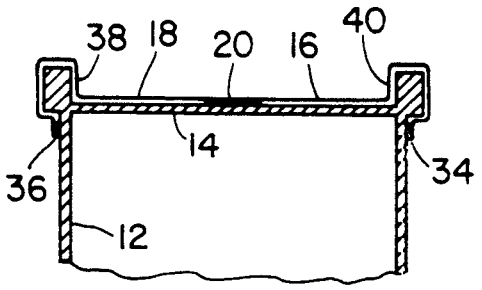
FIG. 2 is a cut-away view of a container top with strips adhered to the side of the container.

As shown in FIG. 2, the strips 16 and 18 can be secured to the side of the container lip 12 by means of an adhesive or solder 34 and 36 and are secured to a central portion of top 14 by means of adhesive or solder 20. When it is desired to cut the can top 14, the strips 16 and 18 also are severed at junctions 38 and 40 and lift away from the can top 14 in the manner shown in FIG. 4. The strips also can have ridged surfaces rather than flat surfaces to improve handling.

Figure 3:
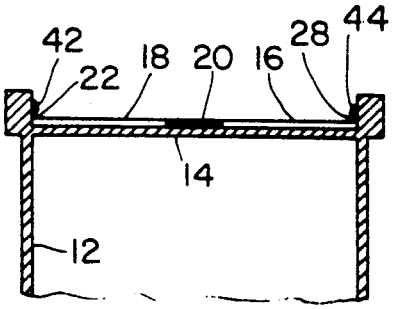
FIG. 3 is a cut-away view of a container top with strips frictionally fit to the top periphery.

In an alternative construction as shown in FIG. 3, the strips 16 and 18 are secured to the central portion of top 14 by adhesive or solder 20. The second ends 22 and 28 are frictionally held in place adjacent lip 24 by adhesive beads 42 or 44 respectively. When the can top 14 is cut, the strips 16 and 18 assume the configuration shown in FIG. 4.

Figure 6:
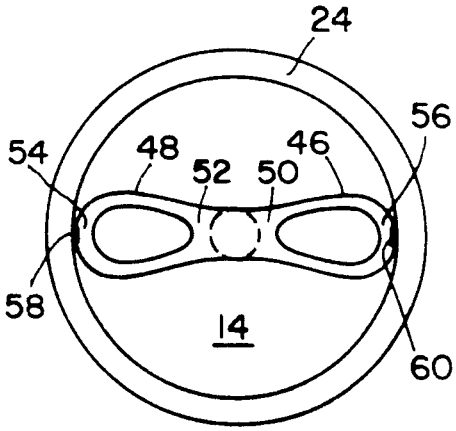
FIG. 6 is a top view of a alternative container top of this invention.

An alternative strip design is shown in FIG. 6 where loops 46 and 48 are provided on strips 50 and 52. The ends 54 and 56 are secured to lip 24 by means of adhesive beads 58 or 60 respectively. When the can top 14 is cut, the strips 52 and 50 assume the position shown in FIG. 4 for strips 16 and 18.

Figure 7:
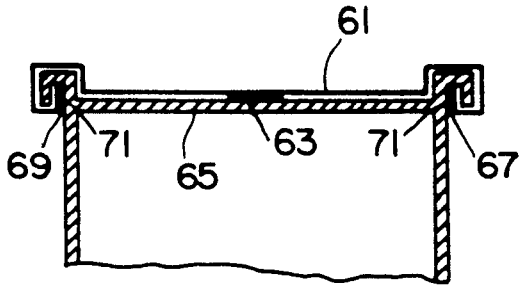
FIG. 7 is a cut away view of a container with the strips crimped with the container cap.

As shown in FIG. 7, the strip 61 is adhered with adhesive 63 to can top 65 and each of its ends 67 and 68 are adhered to the can top periphery 71.

Figure 8:
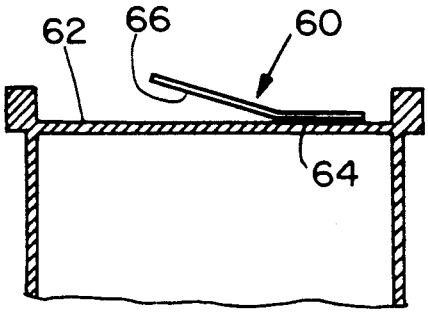
FIG. 8 shows one form of a strip secured with a temporary adhesive and a permanent adhesive.

Referring to FIG. 8, the strip 60 is adhered to can top 62 with a temporary adhesive and a permanent adhesive. The permanent adhesive is positioned on surface 64 of strip 60 while the temporary adherence is positioned on surface 66 of strip 60. The strip 60 is shown after the strip has been exposed to heat or steam sterilization so that the temporary adhesive looses its adhesive strength.

Figure 9:
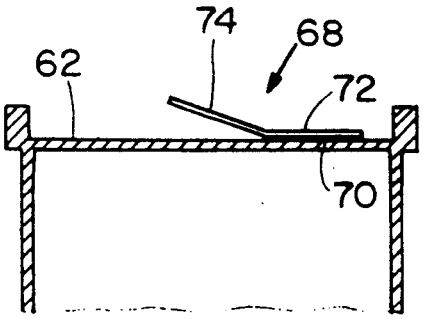
FIG. 9 shows an alternative form of a strip secured with a temporary adhesive and a permanent adhesive.

Referring to FIG. 9, the strip 68 is adhered to can top 62 by permanent adhesive on surface 70 while the surfaces 72 and 74 are secured together by means of a temporary adhesive. The strip 68 is shown after it has been exposed to heat or steam sterilization so that the temporary adhesive looses its adhesive strength. The temporary adhesive provide ease for attaching the prestressed strips conveniently on the can tops prior to the canning so they do not interfere with the can filling operation.

Figure 10:
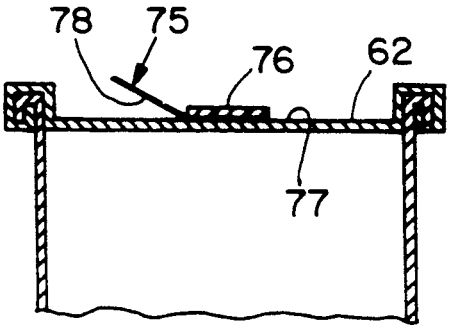

Referring to FIG. 10, the strip 75 is adhered to can top 62 under part of strip 76 by permanent adhesive on surface 77 while the surface 78 has no adhesive, and thus remains lifted up from the container top, because of its pre-stressing, to a position where it can easily be grasped.

I claim:

1. A sealed container having a permanently fixed solid cover to a body having a volume containing a material, said cover being free of holes, grasping member comprising at least one strip means having a first end adhered to a central portion of an exposed surface of said cover, said at least one strip having a second end secured adjacent a peripheral portion of said cover, said at least one strip having a stress bias such that when said second end is unsecured from said peripheral portion of said cover said second end becomes positioned away from contact with said cover, said at least one strip being prestressed and secured to the container in a manner such that when the container top is cut about its periphery when opening the container, the at least one strip, under the prestressing forces, lifts away from the container top to a position where it can easily be grasped.

2. The container of claim 1 which includes a plurality of said strip means.

3. The container of any one of claims 1 or 2, wherein said strip means comprises a metallic strip.

4. The container of any one of claims 1 or 2, wherein said strip means comprises a thermoplastic material.

5. The container of any one of claims 1 or 2, wherein said strip means comprises a thermoplastic filament.

6. The container of any one of claims 1 or 2, wherein said strip means has flat surfaces.

7. The container of any one of claims 1 or 2 wherein a portion of said strip is secured to said cover with a first adhesive capable of retaining its adherence characteristics after being exposed to heat or steam conditions and with a second adhesive on a second portion of said strip wherein said second adhesive loses its adherence characteristics after being exposed to heat or steam conditions.

8. The container of any one of claims 1 or 2 wherein said strip comprises a plurality of layers wherein a layer is prestressed to respond to exposure to radiant energy.

9. The container of any one of claims 1 or 2 wherein a portion of said at least one strip is adhered to said top with an adhesive capable of maintaining adherence under conditions of heat and a portion of said at least one strip is adhered to said top with a second adhesive which loses its adherence under conditions of heat.

10. The container of any one of claims 1 or 2 wherein said at least one strip is crimped with said top to said body.

11. The container of any one of claims 1 or 2 wherein said at least one strip has a ribbed surface.

12. The container of any one of claims 1 or 2 wherein said at least one strip includes a loop.

13. The container of anyone of claims 1 or 2 wherein a portion of said at least one strip is adhered to said top with an adhesive capable of maintaining adherence under conditions of heat and a portion of said at least one strip has no adhesive, but remains lifted up from the container top to a position where it can easily be grasped.

* * * * *